US007168187B2

(12) United States Patent
Robbins

(10) Patent No.: US 7,168,187 B2
(45) Date of Patent: Jan. 30, 2007

(54) FOOTWEAR CONSTRUCTION AND RELATED METHOD OF MANUFACTURE

(75) Inventor: Kenneth J. Robbins, Somerset (GB)

(73) Assignee: Wolverine World Wide, Inc., Rockford, MI (US)

( * ) Notice: Subject to any disclaimer, the term of this patent is extended or adjusted under 35 U.S.C. 154(b) by 292 days.

(21) Appl. No.: 10/858,348

(22) Filed: Jun. 1, 2004

(65) Prior Publication Data

US 2005/0262728 A1 Dec. 1, 2005

(51) Int. Cl.
*A43B 13/12* (2006.01)
*A43C 13/08* (2006.01)

(52) U.S. Cl. ..... 36/30 R; 36/25 R; 36/14; 36/21

(58) Field of Classification Search ..... 36/25 R, 36/30 R, 28, 12, 14, 21
See application file for complete search history.

(56) References Cited

U.S. PATENT DOCUMENTS 4,481,725 A 11/1984 Bergmans
4,642,915 A 2/1987 Pfander
4,662,018 A 5/1987 Autry
4,685,223 A 8/1987 Long
4,694,591 A 9/1987 Banich et al.
4,704,808 A 11/1987 Bianchini et al.
5,092,060 A * 3/1992 Frachey et al. ..... 36/29
5,311,674 A 5/1994 Santiyanont et al.
5,325,611 A * 7/1994 Dyer et al. ..... 36/30 R
5,367,791 A * 11/1994 Gross et al. ..... 36/31
5,467,536 A 11/1995 Ramer et al.
5,784,736 A 7/1998 Issler et al.
5,815,949 A 10/1998 Sessa
5,893,186 A 4/1999 Issler et al.
6,029,301 A 2/2000 Issler et al.
6,038,790 A * 3/2000 Pyle et al. ..... 36/30 R
6,041,521 A * 3/2000 Wong ..... 36/28
6,474,003 B2 11/2002 Erickson et al.

(Continued)

FOREIGN PATENT DOCUMENTS

EP 0 202 713 5/1986

(Continued)

OTHER PUBLICATIONS

Prior Art Reference A.

(Continued)

*Primary Examiner*—Marie Patterson
(74) *Attorney, Agent, or Firm*—Warner Norcross & Judd

(57) ABSTRACT

An article of footwear including a shell that provides stability. The shell can include a heel cup and a wall extending forward of the heel cup and around the periphery of the forefoot, returning to the heel cup. The shell can also define a hole in the forefoot region. A cushion in the form of a midsole can be secured in the shell, with a portion extending at least partially through the shell hole. An upper can be secured to the shell with stitching passing through the upper and the shell wall in at least the forefoot region; and rearward of the stitching, the upper can be secured with cement and/or adhesives to the shell and/or the midsole. The footwear provides comfort and stability, for example toe-to-heel and lateral stability, especially during toe-off, i.e., the propulsion portion of a gait.

13 Claims, 7 Drawing Sheets

U.S. PATENT DOCUMENTS

| | | | | |
|---|---|---|---|---|
| 6,574,886 | B1 | 6/2003 | Issler et al. | |
| 2002/0170204 | A1 | 11/2002 | Chen | |
| 2003/0089000 | A1 | 5/2003 | Tseng | |
| 2003/0226282 | A1 | 12/2003 | Ho et al. | |
| 2005/0268491 | A1* | 12/2005 | McDonald et al. | 36/28 |

FOREIGN PATENT DOCUMENTS

| | | |
|---|---|---|
| FR | 2823079 | 10/2002 |

OTHER PUBLICATIONS

Prior Art Reference B.

* cited by examiner

FOOTWEAR CONSTRUCTION AND RELATED METHOD OF MANUFACTURE

BACKGROUND OF THE INVENTION

The present invention relates to footwear and, more particularly, to a footwear construction and method for making the same.

There is an ongoing effort in the footwear industry to produce footwear that provides stability and a high level of comfort. Such footwear is targeted toward individuals who commute in urban environments, who travel on foot for significant distances on hard surfaces (e.g., concrete floors), or who require comfortable, yet stable footwear.

Conventional footwear constructions, however, provide one of stability or comfort—but usually not both—because the features required for these characteristics typically negate one another. For example, one construction known for its stability includes a heel cup positioned in the heel of the footwear. The heel cup wraps upward around the user's heel, and terminates short of the arch region. The heel cup firmly seats the user's foot in the footwear, and minimizes roll of the user's heel when the heel is properly seated in the heel cup.

Although this construction provides stability of the foot in the heel region, it fails to provide stability and torsion resistance for the remainder of the foot. Furthermore, the region where the heel cup terminates in the arch region undergoes significant stresses due to the twisting of heel cup. Accordingly, the heel cup can cause premature de-lamination or destruction of other footwear components, thereby shortening the useful life of the footwear.

At the end of the footwear spectrum, opposite heel cup constructions, are constructions built primarily for comfort, for example, casual shoe constructions. In these "comfort" constructions, a midsole and/or outsole is secured to an upper. The outsole usually is constructed from a hard wearing material. The midsole usually is constructed of a soft material such as polyurethane or ethylvinyl acetate to provide a layer of shock-absorption material. Although this construction provides comfortable cushioning for the wearer's foot, the soles wear out and the uppers detach from the soles in a short time. Moreover, the transition between the upper and the sole of such constructions typically are abrupt and aesthetically displeasing.

Although different constructions exist that provide either stability of comfort, there remains an unmet need for a footwear construction that provides the best of both requirements.

SUMMARY OF THE INVENTION

The aforementioned problems are overcome in the present invention, which provides a footwear construction including a shell with stabilizing features. The shell can include a heel cup in the heel region and a peripheral wall that extends from the heel cup, forward of the heel region, wrapping around at least a portion of the forefoot region. The shell also can define a hole in the forefoot region, optionally adjacent the peripheral wall.

In another aspect, the shell can be at least partially filled with a midsole cushioning material. Where the shell defines a hole, that material can extend into and optionally through the hole.

In a third aspect, an upper can be stitched, for example, with Opanka stitching techniques, to the shell in the forefoot region, and optionally at least partially in the arch region.

The stitching can terminate short of the heel region. In a more specific aspect, the upper can include a Strobel construction in the heel region, and that Strobel construction can be secured to the midsole and/or shell, for example, with adhesives.

In another aspect, an outsole can be secured to the shell opposite the upper. The outsole can include a forefoot portion and a separate heel portion. The outsole forefoot portion can define at least one aperture. A portion of the midsole that optionally projects through the hole defined in the shell may also project into and/or through the aperture defined by the outsole.

The present invention can be manufactured by: forming a shell including a heel cup and a peripheral wall that extends forward of the heel region around at least a portion of the forefoot region; securing a cushion material within the shell; optionally Opanka stitching an upper to the shell in the forefoot region, but short of the heel region; optionally securing the upper to at least one of the shell and the cushion material in the heel region; optionally defining a hole in the forefoot portion of the shell; and optionally extending the cushion material at least partially into or through the hole.

The present invention provides a revolutionary footwear construction with an unparalleled combination of stability, comfort and styling. The shell provides both lateral and medial reinforcement for underfoot stability. Where the shell extends underfoot into the arch region, it provides an integrated arch support, as well as forefoot and rear-foot stability. Furthermore, where the shell defines a hole in the forefoot, the shell can provide both stiffness in the heel for strike stability, as well as lightness and lateral stability in at least the forefoot for easier toe-off, i.e., propulsion.

These and other objects, advantages and features of the invention will be more readily understood and appreciated by reference to the detailed description of the invention and the drawings.

DETAILED DESCRIPTION OF THE INVENTION

Figure 1:
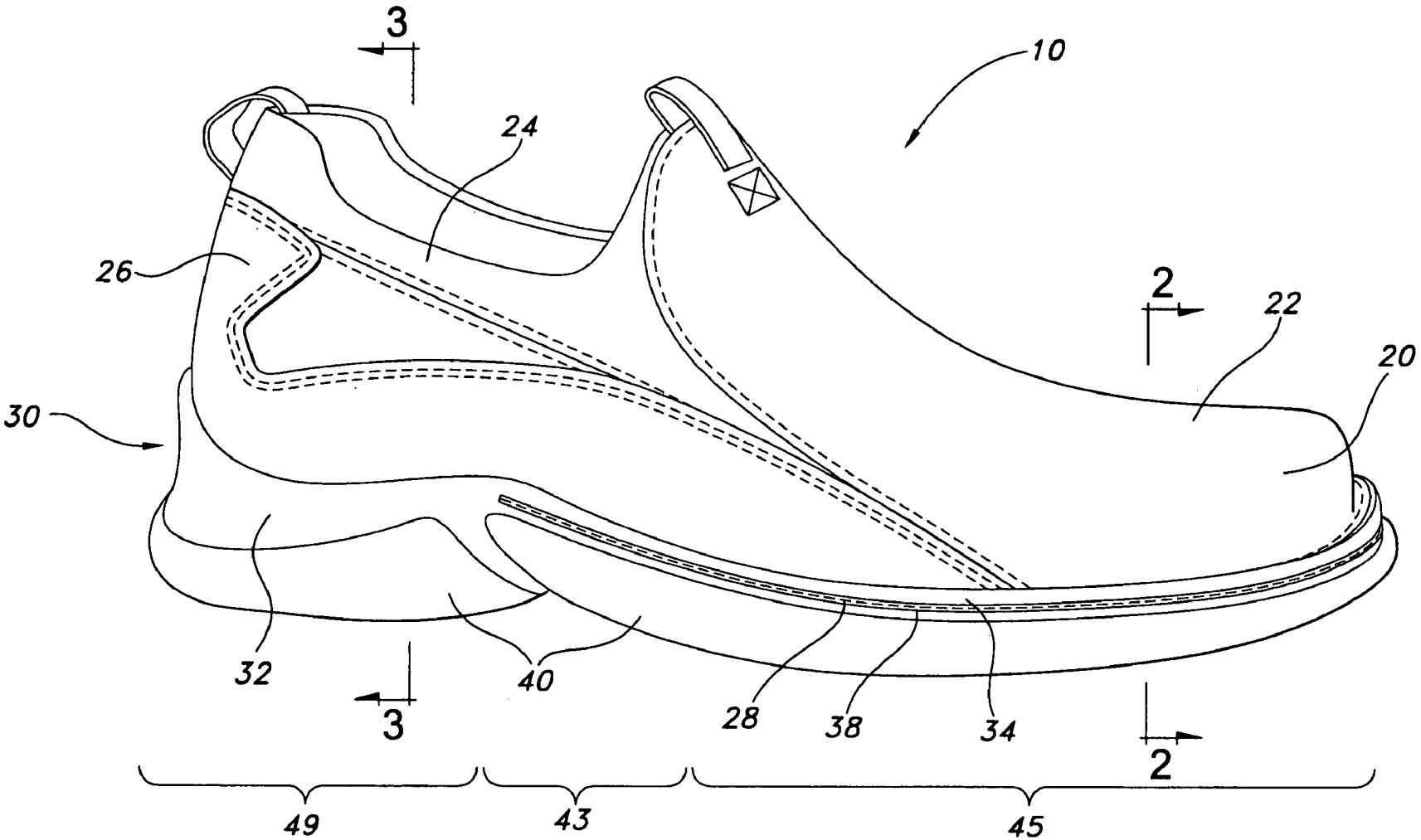
FIG. 1 is side elevational view of an article of footwear incorporating the construction of the present invention.
Figure 3:
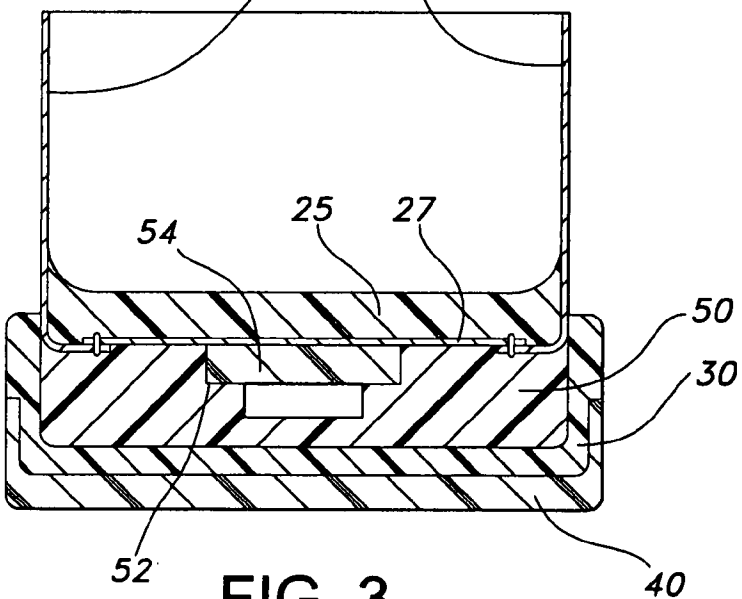
FIG. 3 is a sectional view of the footwear taken along line 3—3 of FIG. 1.
Figure 2:
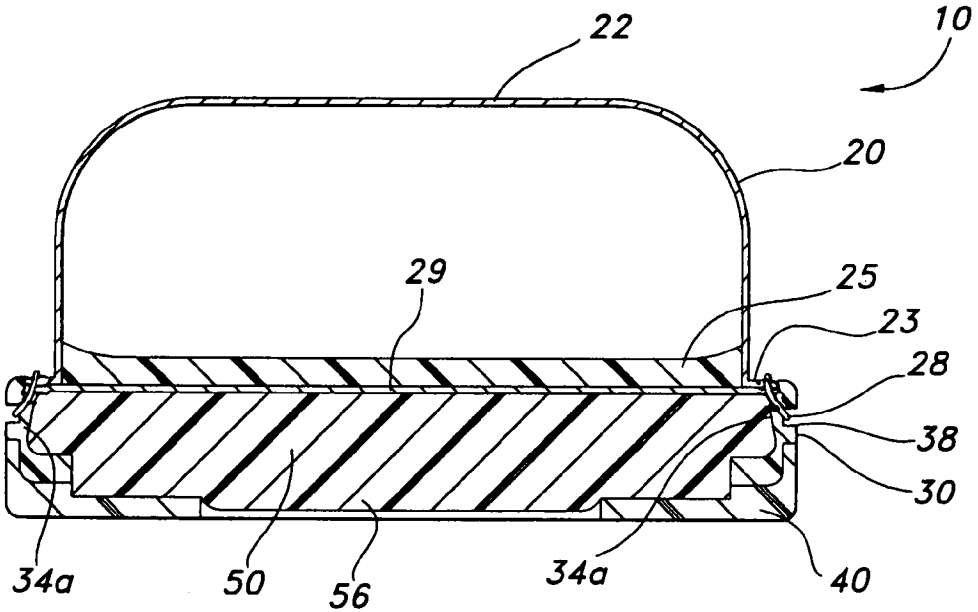
FIG. 2 is a sectional view of the footwear taken along line 2—2 of FIG. 1.

A footwear construction of the present invention is shown in FIG. 1 and generally designated 10. For purposes of the disclosure, the present invention is described in connection with a casual shoe, however, the present invention is well suited for use with other types of footwear.

In general, the shoe 10 can include an upper 20 secured to a shell 30, which can be further secured to an outsole 40. The shell 30 can include a heel cup portion 32 and a wall 34 extending around the periphery of the shoe in the forefoot region. The upper 20 can be secured to the shell with stitching 28 in the forefoot region and at least a portion of the arch region. Rearward of the stitching, the upper can be secured with cement and/or adhesives to the shell.

As used herein, the term "arch region" refers generally to the portion of the shoe corresponding to the arch of the wearer's foot; the term "forefoot region" refers generally to the portion of the shoe forward of the arch region corresponding to the forefoot (e.g., the ball and the toes) of a wearer's foot; and the term "heel region" refers generally to that portion of the shoe rearward of the arch region corresponding to the heel of the wearer's foot. The forefoot region 45, arch region 43 and heel region 49 are generally identified in FIG. 1, however, it is to be understood that delineation of these regions may vary depending upon the configuration of the footwear.

Figure 4:
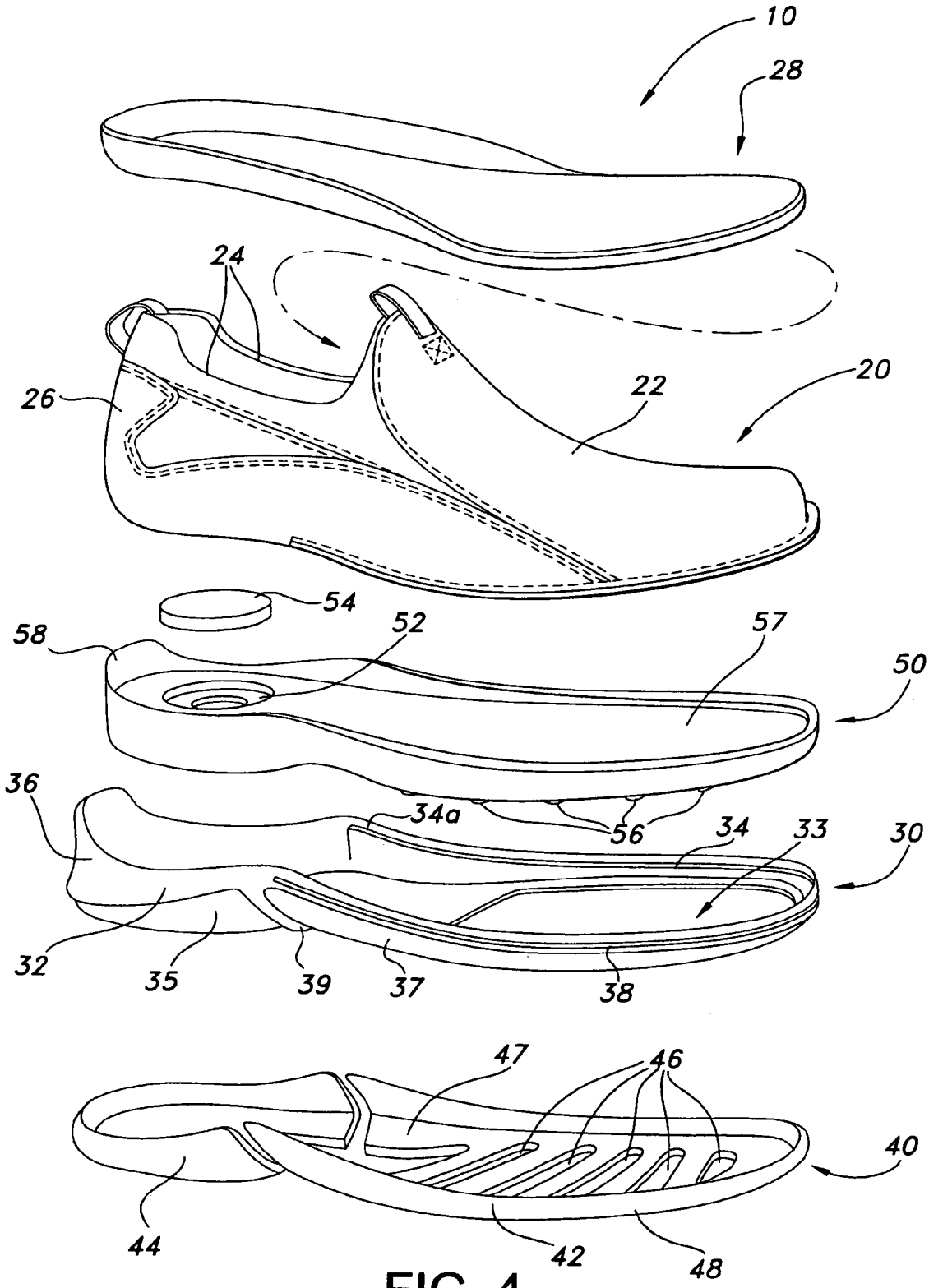
FIG. 4 is an exploded perspective view of the footwear.

The upper 20 is generally conventional and will not be described in detail. Suffice it to say that the upper 20 can include vamp 22, quarters 24 and backstay 26. With reference to FIG. 4, the upper 20 can include a lower portion that transitions to an allowance 23, also referred to as a stitching allowance, which is folded outward away from the center of the upper. A sock or other material can be secured to the lowermost portion of the upper. This sock can optionally extend from heel to toe, and/or from one side of the shoe to the other, so that the upper 20 is closed on its bottom. The peripheral allowance also can be secured to an insole (not shown), or optionally Strobel stitched to material 29 and/or fabric sock liner (not shown). With this construction, the upper can be closed along all or a portion of its bottom. The upper 20 may be manufactured from leather, canvas, nylon, or other suitable materials and may include other conventional accessories.

A foot bed 25 can be positioned in the upper 20. The foot bed can be constructed from ethylvinyl acetate (EVA) foam, or any other suitable cushioning material. The rigidity and the flexibility of the EVA foam can be varied from application to application as desired. The foot bed can be secured to the closed bottom of the upper as desired as well to ensure it does not move within the upper.

The outsole 40 is manufactured from a relatively hard rubber or other sufficiently durable and wear-resistant material. This outsole can be divided into at least two separate or independent pieces. As shown, the outsole includes a forefoot portion 42, which corresponds generally to the forefoot region of the footwear, and a heel portion 44, which corresponds generally to the heel region of the footwear. These portions can be separated from one another a pre-selected distance. Each of these portions can be contoured to interfit with raised portion 39 on the bottom of the shell 30. The raised portion 39 can serve as a boundary between the forefoot and heel portions of the outsole, and can separate those elements as well. Further, the outsole portions 42 and 44 can be shaped to correspond to the recesses 35 and 37 formed on the shell 30. Accordingly, when secured to the shell, these outsole components have a flush and finished appearance.

The bottom of the outsole 40 includes an outer surface 48 that forms the wearing surface of the outsole 40 and is contoured to the desired tread pattern. The outer surface 48 can be textured to improve the traction and aesthetic appeal of the shoe. Optionally, the upper surface 47 of the outsole may be textured as desired. As shown in FIG. 4, the forefoot portion 42 of the outsole can define at least one hole 46. The holes 46 can be aligned with the optional protrusions 56 formed on the undersurface of the midsole 50. The protrusions can also be of sufficient depth that they extend at least partially into and/or through the holes 46 as described below. The outsole 40 can be secured to the shell 30 and/or midsole 50 that is exposed through the hole 33 with cement or adhesives, or as desired, direct attached to these components.

Figure 5:
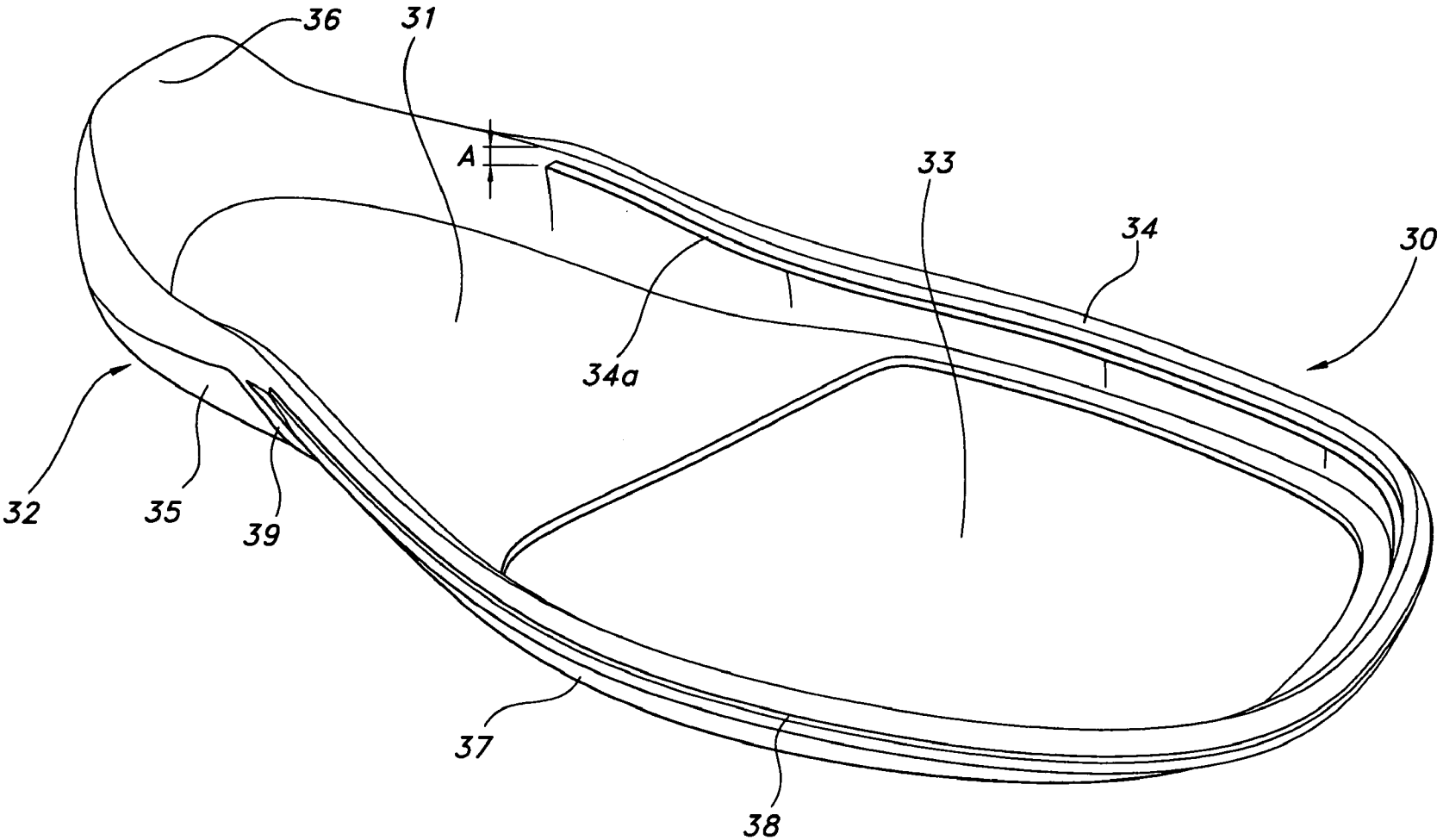
FIG. 5 is a perspective view of the shell of the footwear.
Figure 6:
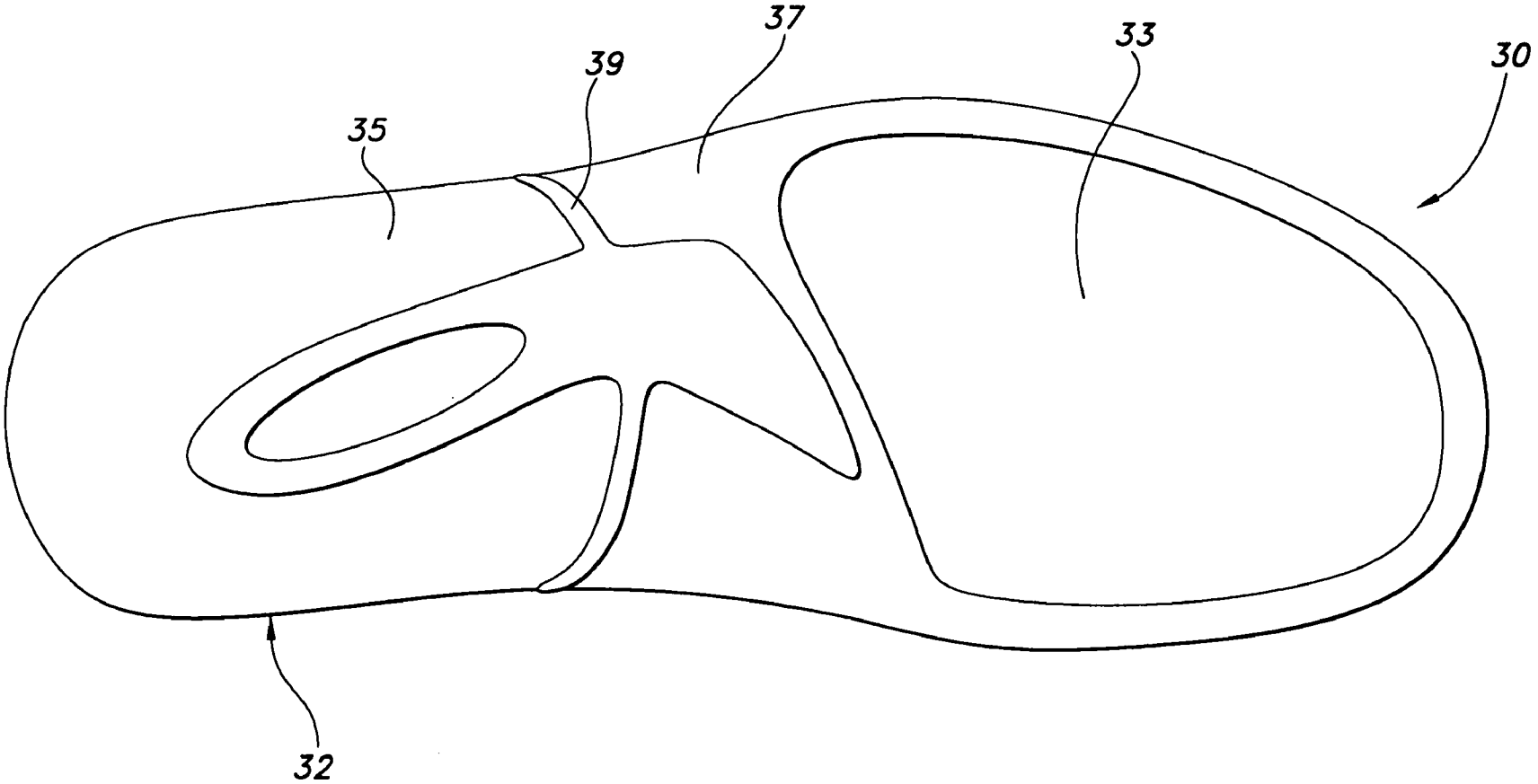
FIG. 6 is a bottom plan view of the shell.

With reference to FIGS. 4–6, the shell 30 will be described in more detail. The shell includes a heel cup portion 32, which includes and upwardly extending wall 34 that extends forward from the heel region and optionally around the entire periphery of the forefoot portion of the footwear. These components of the shell can be unitary so that the shell is formed from one-piece of material. The heel cup may be bounded underfoot by a base plate 31, which also may extend into the arch and forefoot regions of the shell. The peripheral wall 34 can extend generally upwardly and perpendicular to the base plate 31 as desired. The outer portion of the peripheral wall 34 in the forefoot region, and optionally in the arch and heel regions, can also define a stitching groove 38 within which thread 28 or other stitching material may be stitched. When stitched within this groove 38, the stitching 28 can be protected from abrasion and premature wear.

In the forefoot region 45 and/or arch region 43 of the footwear, the shell can define a hole 33. This hole 33 can be bounded by remaining portions of the base plate 31, or where the base plate is completely removed from the shell in the forefoot region, the hole can be bounded by the peripheral wall 34 itself. This hole can extend from generally from the portion of the footwear corresponding to the bottom of the ball of a wearer's foot to the toe of the footwear as desired.

In the forefoot region 45 and/or arch region 43 of the footwear, the shell can also include a ledge 34*a*, which projects outwardly from the wall 34 and/or the heel cup portion 32. This ledge 34*a* can coterminate with the stitching groove 38 as desired. The ledge can also project outwardly from the wall and/or heel cup portion a depth A from the top of those components of the shell. This depth A can be equal to the thickness of the peripheral allowance and any material secured to that allowance to close the bottom of the upper if desired. Moreover, this depth A can also correspond to and/or be equal to distance D as described below.

The exterior portions of the shell 30 can include a graphic design or text as desired. On the bottom of the shell 30, opposite the midsole 50, the shell can include at least one raised portion 39. The raised portion can be visible even when the outsole 40 and its components 42 and 44 are attached to the shell 30. The raised portion 39 can include a design (not shown) that is visible from the bottom of the shoe, even when the outsole portions 42 and 44 are secured to the shell 30. This design may also be colored or include graphic images or text as desired.

The bottom of the shell 30 can define recesses 35 and 37, which correspond to the shape of the outsole components 42 and 44, so that when these components are secured to the shell, they mount flush for a clean, finished appearance.

The shell and its components can be constructed from polyurethane, for example, thermoplastic polyurethane, or other sufficiently ridged and/or semi-ridged materials, which can be synthetic or natural.

The shell 30, including the recess defined by the heel cup portion 32 and the peripheral wall 34 in the forefoot region, can be filled with a cushion material, also referred to herein as a midsole 50. The cushion material can be poured, injected, or otherwise molded in the shell as desired. The midsole can fill the recess formed by the heel cup 32 and the peripheral wall 34 to a depth that enables the wall 34 to be exposed above the uppermost portion of the midsole 50. Optionally, the cushioning material 50 may be formed within the shell so that in at least the forefoot region 45 a distance D (FIG. 7) of the wall 34 is exposed above the uppermost portion of the cushioning material 50 in the forefoot. Accordingly, the allowance 23 can be stitched to the portion of the wall 34 exposed above the cushion material, and optionally through the cushioning material as well. With this construction, the edge of the peripheral allowance can abut the exposed shell wall 34, and/or can be concealed from view. The midsole 50 can define a recess 57 which conforms generally to the shape of a wearer's foot.

The midsole can define an air cushion recess 52 in the heel region 49 to receive an air cushion 54. The midsole can also include a midsole heel wall 58, which extends partially up the shell heel wall 36. On the underside of the midsole 50, protrusions 56 can be formed. These protrusions can extend at least partially through the hole 33, and as desired, into or at least partially through the holes 46 defined by the outsole. These protrusions 56 can be colored as desired.

Optionally, a shank (not shown) of steel, plastic, nylon or other material may be secured or molded in the cushioning material that forms the midsole 50 in the arch region 43 of the shoe. The shank can extend and/or overlap with other regions of the footwear, for example the forefoot region 45 and the heel region 49.

MANUFACTURE AND ASSEMBLY

Manufacture of the shoe 10 will now be described with reference to FIGS. 4–7. The upper 20 is manufactured using generally conventional techniques and apparatus. The desired upper material (not shown) is cut to form the upper, including its elements, such as the vamp 22 quarters 24 and back stay 26. Pieces of the upper 20 can be fitted and sewn together. A piece of material 27, generally the same shape as the foot, can be Strobel stitched to the bottom of the upper to close the upper in the heel and/or from heel-to-toe. A sock (not shown) can also be secured to the inside of the upper so that the bottom of the upper 20 is closed.

In another step, the shell 30 is formed. Material from which the shell is made can be injected into a mold shaped to correspond to the features of the shell, for example, the heel 32, the peripheral wall 34, the base plate 31, the stitching groove 38 and/or the raised portion 39 on the underside of the shell. The mold can be contoured so that the hole 33 is formed in the shell as it is formed. However, the shell can also be formed without the hole, and the hole 33 trimmed from the shell after it is formed. Further, the exposed portion of the shell may be printed with a graphic design via any conventional printing methods, for example, oil printing, lithograph and/or airbrush. The shell 30 can be trimmed as desired. Other techniques can be used to form the shell as desired.

Figure 7:
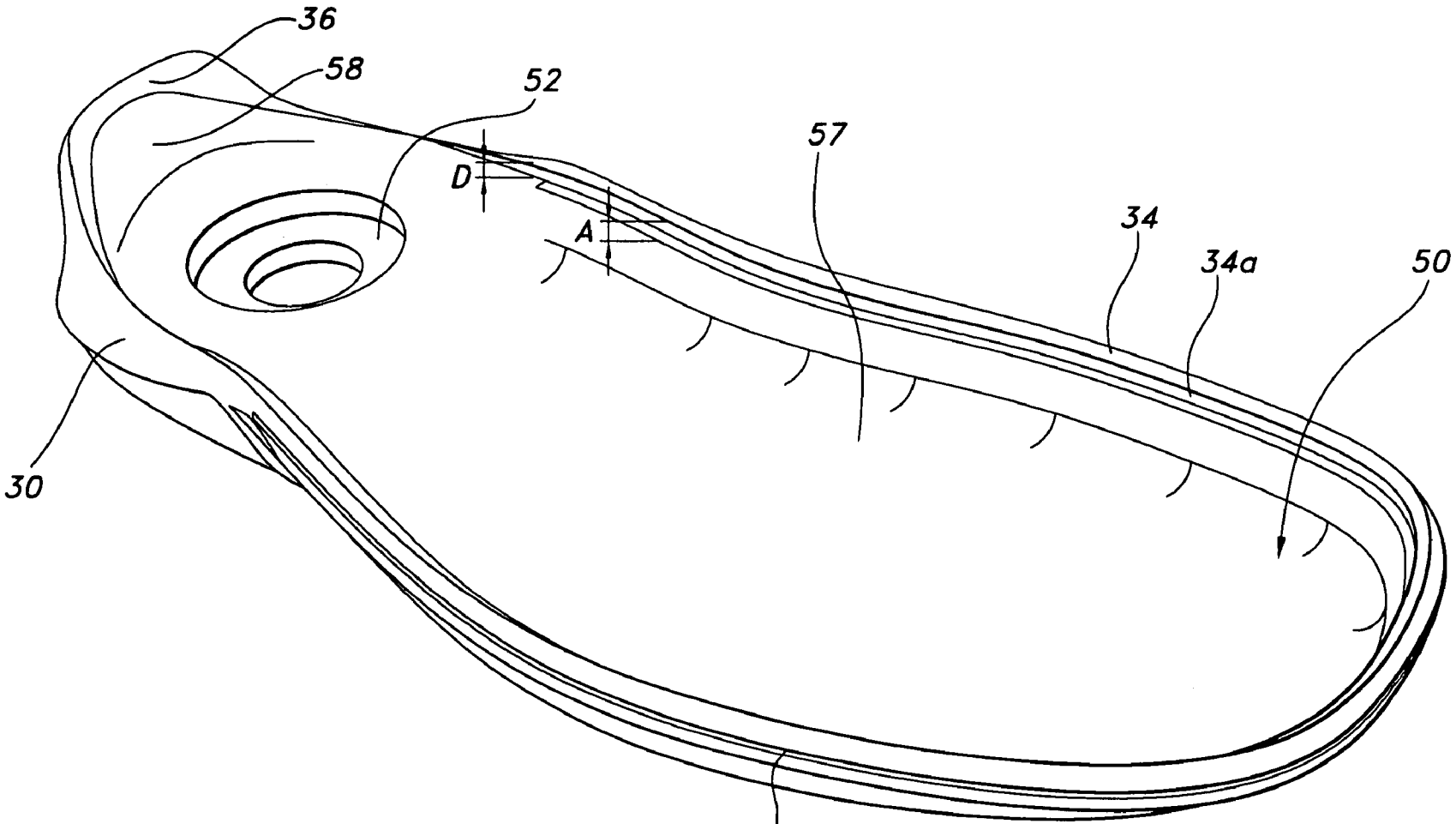
FIG. 7 is a perspective of the shell filled with cushion material.
Figure 8:
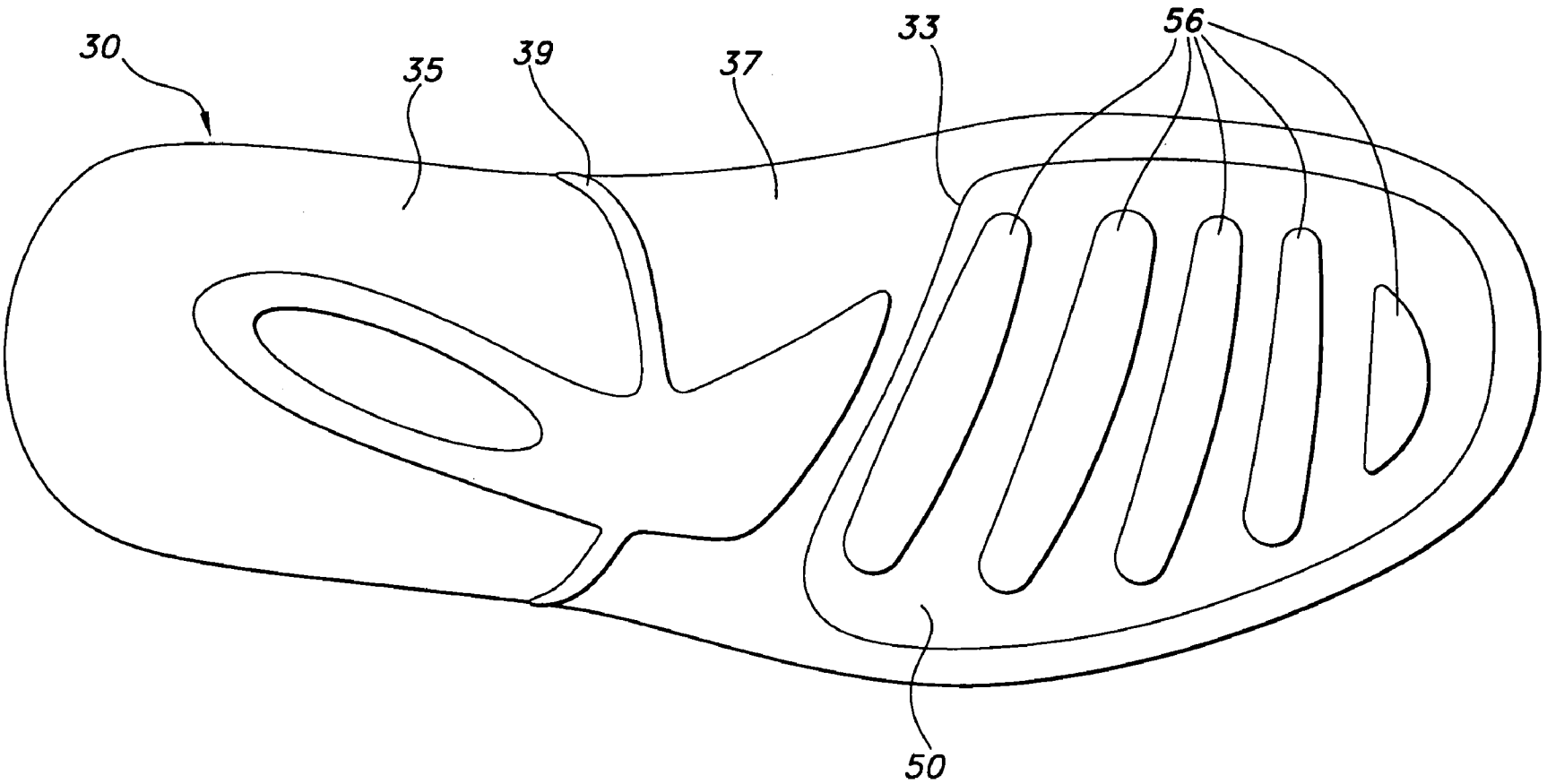
FIG. 8 is a bottom plan view of the shell filled with cushion material.

With the shell formed, the cushion material 50 can be secured to the shell. The material 50 can be pour molded into the cavity formed by the heel cup and the peripheral wall. When the material fills this cavity, it can also at least partially extend within or through the hole 33 of the shell. Optionally, a secondary mold (not shown) can be positioned adjacent the bottom of the shell so that protrusions 56 are formed in the cushion material that is exposed through the hole 33. These protrusions can be contoured and shaped so that they align with corresponding holes 46 in the outsole. Further, the cushion material 50 can be filled in the shell to a specific depth so that a portion of the peripheral wall 34 is exposed a distance D, and optionally, the ledge 34*a* is exposed as well, as shown in FIG. 7. This distance D can be about the same as and/or greater than the thickness of the leather that forms the stitching allowance 23, and any material that is secured to the midsole-facing portion of that stitching allowance. In this manner, the edge of the peripheral allowance 23 can be un-exposed to the environment. Of course, if desired, the cushion material 50 can fill the shell to the upper most portion of the wall so that the material is flush with the top of the wall 30.

It is noted that the portion of the shell wall 34 that is exposed above the cushion material can be a completely separate component from the cushioning material 50 that forms the midsole. In this configuration the two components, i.e., the wall 34 in the midsole 50 are separate and independent components.

As the midsole 50 is formed, features, such as the air cushion hole 52 and stitching guide holes, can also be formed in the upper surface of the cushioning material 50.

The outsole components 42 and 44 can be injection molded or pour molded from a hard, durable rubber using conventional molding apparatus. The tread pattern 48 on the lower surface of the outsole, as well as the holes 46 defined in the forward portion 42 of the outsole can be formed during the molding operation. Optionally these features, as well as any contours or shapes of the outsole components, can be cut through the outsole 40 after it is molded. It is noted that the holes 46 can be cut so that they align with the protrusions 56 of the midsole. The outsole and its components can be secured to the shell with cement, adhesives or other attachment devices.

The outsole components 42 and 44 also can be aligned with the raised portion 39, and within respective shell recesses 35 and 37, and then secured to the shell 30. When included, the protrusions 56 of the midsole also can be aligned with the holes 46 in this securing process. The outsole components may be trimmed as desired to ensure a flush and clean fit with the shell 30.

In another step, the shell 30 with the cushion material 50 secured therein is attached to the upper. This can be accomplished by stitching the peripheral allowance 23 to the shell wall 34 in the forefoot regions 45 and optionally the arch region 43. The stitching can be accomplished via machine or hand stitching. More specifically, the peripheral allowance can be Opanka stitched to the shell and/or midsole in the forefoot region 45. The stitching can be protected from abrasion by the passing through the shell within the groove 34, through the peripheral allowance 23, back through the peripheral allowance 23 and then back through the shell 30 repeatedly. In the heel 49 and/or arch regions 43 of the shoe, the upper can be secured with glue to the upper surface of the cushioning material 50, and over the air cushion 54 when included. The upper optionally can be further glued to the heel flanges 58 of the midsole and the heel wall 36 of the shell.

With the outsole 40 secured to the upper 20, the foot bed 25 can be positioned in the interior of the upper 20. A number of conventional finishing operations can be performed on the shoe 10. For example the edges of the shell 30 and outsole 40 can be trimmed and shaped; the upper 20 can be cleaned, polished and treated as appropriate and necessary; and where applicable, laces can be inserted into eyelids.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "the," is not to be construed as limiting the element to the singular.

The invention claimed is:

1. A footwear construction including a forefoot region and a heel region comprising:

an upper including a peripheral allowance;

a one-piece, unitary, substantially rigid shell including a heel cup, a forefoot portion and a periphery, the heel cup including a base plate extending toward the forefoot portion, the forefoot portion including a wall extending generally upwardly in relation to the base plate, the wall further extending around the periphery in at least the forefoot portion so that the wall and heel cup cooperate to form an upwardly opening recess, the shell defining a hole in the forefoot portion, the hole terminating short of the heel portion;

a cushioning material positioned in the upwardly opening recess of the shell, the cushioning material extending at least partially into the hole; and an outsole secured to the shell, wherein the peripheral allowance is joined with stitching to the shell in the forefoot region, the stitching terminating short of the heel region;

wherein the upper is adhered to at least one of the shell and the cushioning material in the heel region.

2. The footwear construction of claim 1 wherein the outsole includes a first outsole component positioned in the heel region and a second outsole component in at least the forefoot region, the second component separated from the first component by a distance.

3. The footwear construction of claim 1 wherein the shell defines at least one recess within which the outsole is secured to the shell.

4. The footwear construction of claim 1 wherein the outsole defines a plurality of apertures.

5. The footwear construction of claim 1 wherein the cushioning material extends through the hole and at least partially into the apertures defined by the outsole.

6. The footwear construction of claim 1 wherein the shell defines a stitching groove in which the stitching is positioned.

7. The footwear construction of claim 1 wherein the cushioning material is positioned in the upwardly opening recess of the shell so that a portion of the wall remains exposed in the forefoot region, wherein the stitching is stitched through the exposed portion of the wall.

8. A footwear construction including a forefoot region, and arch region and a heel region comprising:

an upper including a peripheral allowance;

a shell including a base plate and a wall extending substantially upwardly from the base plate around a periphery having a shape of a wearer's foot, the wall and base plate cooperating to define an upwardly opening recess, the base plate defining a base plate hole in substantially only at least one of the arch region and the forefoot region;

an outsole secured to the shell;

a cushion positioned at least partially within the shell, with at least a portion of the cushion remaining above the base plate hole, adjacent the base plate, and another portion extending through the hole; and stitching that passes through the peripheral allowance and the shell to secure the shell and the peripheral allowance to one another.

9. The footwear construction of claim 8 wherein the wall and the base plate cooperate to define a heel cup in the heel region.

10. The footwear construction of claim 8 wherein the cushion includes at least one protrusion that extends through the hole.

11. The footwear construction of claim 8 wherein the outsole defines at least one aperture.

12. The footwear construction of claim 8 wherein the cushion extends through the hole and at least partially into an aperture defined by the outsole.

13. The footwear construction of claim 8 wherein the shell is one-piece, substantially rigid and constructed from thermoplastic polyurethane.

* * * * *